US007594867B2

(12) United States Patent
Nardacci

(10) Patent No.: US 7,594,867 B2
(45) Date of Patent: Sep. 29, 2009

(54) SURFACE PATTERN FOR GOLF BALLS

(75) Inventor: Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 1084 days.

(21) Appl. No.: 10/638,535

(22) Filed: Aug. 12, 2003

(65) Prior Publication Data

US 2005/0037871 A1 Feb. 17, 2005

(51) Int. Cl.
*A63B 37/14* (2006.01)

(52) U.S. Cl. ..... 473/383

(58) Field of Classification Search ..... 473/351–384
See application file for complete search history.

(56) References Cited

U.S. PATENT DOCUMENTS 4,720,111 A * 1/1988 Yamada ..... 473/382
4,836,552 A 6/1989 Puckett et al.
4,839,116 A 6/1989 Puckett et al. ..... 264/45.3
5,006,297 A 4/1991 Brown et al. ..... 264/234
5,029,870 A 7/1991 Concepcion et al.
5,916,044 A 6/1999 Shimosaka et al. ..... 473/384
5,957,786 A * 9/1999 Aoyama ..... 473/379
6,179,731 B1 * 1/2001 Shimosaka et al. ..... 473/384
6,383,092 B1 5/2002 Ogg ..... 473/378
6,471,605 B2 10/2002 Ogg ..... 473/383

* cited by examiner

*Primary Examiner*—Alvin A Hunter
(74) *Attorney, Agent, or Firm*—Hanify & King, P.C.

(57) ABSTRACT

A golf ball surface pattern including depressions and protrusions is disclosed and claimed. In one embodiment, the depressions and protrusions are positioned on the ball according to a known dimple pattern, with some of the dimples being replaced with protrusions. In another embodiment, the depressions are positioned on the ball according to a known dimple pattern, and protrusions are positioned on the land areas. Alternatively, protrusions can be positioned on the ball according to a known dimple pattern, and depressions positioned on the land areas. The turbulence generators (dimples and protrusions) that are positioned on the land areas can be positioned manually or with a distribution scheme. In another embodiment, the turbulence generators are positioned according to a scheme based on the principles of electromagnetic theory.

36 Claims, 6 Drawing Sheets

SURFACE PATTERN FOR GOLF BALLS

BACKGROUND OF THE INVENTION

1. Field of the Invention

The present invention relates generally to surface patterns for round objects. In particular, the present invention relates to surface patterns for golf balls, the surface patterns including both depressions and protrusions.

2. Description of the Related Art

Soon after the introduction of the smooth surfaced gutta percha golf ball in the mid nineteenth century, players observed that the balls traveled further as they got older and more gouged up. The players then began to roughen the surface of new golf balls with a hammer to increase flight distance. The bramble ball, which was introduced around the turn of the $20^{th}$ century, was formed with bumps on the surface of the ball. Eventually, manufacturers began to manufacture golf balls having dimples formed in the outer surface.

The dimples on a golf ball are important in reducing the aerodynamic forces generated by a ball in flight as a result of the ball's velocity and spin. These forces, which overcome the force of gravity, are lift and drag.

The lift force acts perpendicular to the direction of flight and is a result of air velocity differences above and below the rotating ball. Recognition of this phenomenon is attributed to Magnus and is described by Bernoulli's Equation. Bernoulli's Equation, which is a simplification of the first law of thermodynamics, relates pressure and velocity:

$$p + \frac{1}{2}\rho V^2 + \rho g h = c,$$

where p is the pressure, ρ is the density, V is the velocity, g is the gravitational acceleration, h is elevation, and c is a constant along a streamline. We see from Bernoulli's Equation that pressure is inversely proportional to the square of velocity. With respect to the flight of a golf ball, the velocity differential—faster moving air on top of the ball and slower moving air on the bottom of the ball—results in lower air pressure on top and an upward directed force on the ball.

The drag force acts opposite to the direction of flight and orthogonal to the lift force. The drag force on a golf ball is attributed to parasitic drag forces, which consist of form or pressure drag and viscous or skin friction drag. A sphere is a bluff body, an inefficient aerodynamic shape. Therefore, the accelerating flow field around the ball causes a large pressure differential with high-pressure forward of the ball and low-pressure rearward of the ball. This pressure differential causes the flow to separate from the outer surface of the ball, resulting in the majority of the drag force on the ball. In order to minimize pressure drag, dimples are provided as a means to energize the flow field and delay the separation of flow, thus reducing the low-pressure region behind the ball. However, this reduction of pressure drag increases skin friction, which is due directly to the shear stress on the ball. Skin friction is a viscous effect residing close to the surface of the ball within the boundary layer, a thin layer of fluid (air) near the ball surface in which the velocity changes from zero at the ball surface to the free stream value away from the ball surface. The dimples provide an optimal amount of disturbance to trigger a laminar to turbulent flow transition while maintaining a sufficiently thin boundary layer region for viscous drag to occur.

One way to characterize the nature of a fluid flow is by its Reynolds Number. Reynolds Number, which is a dimensionless parameter, is a measure of the ratio of the inertia forces and viscous forces on an element of fluid within the flow:

$$\mathrm{Re} = \frac{\rho V l}{\mu},$$

where Re is the Reynolds Number, ρ is the density, V is the velocity, l is a characteristic length, and μ is the viscosity. At high Reynolds Numbers, the most effective method of reducing aerodynamic drag is to minimize the pressure drag. While present golf ball designs predominantly utilize dimples to trigger turbulence, early golf balls used protrusions to reduce drag, and some known golf balls have used a combination of concentric protrusions and depressions (dimples) to do so.

Some brambled golf ball designs have been presented in more recent times. For example, U.S. Pat. Nos. 4,836,552 and 4,839,116 disclose a short distance golf ball that may have a brambled surface in order to increase drag and thereby reduce velocity. The golf ball is designed for use on short golf courses.

U.S. Pat. No. 5,916,044 discloses a golf ball having dimples and protrusions, with each protrusion having a dimple positioned therein. This design allows a golf ball having a small nominal diameter to pass the USGA minimum diameter test.

U.S. Pat. Nos. 6,471,605 and 6,383,092 disclose a golf ball having a surface containing pyramidal projections. These projections are also used to allow a ball having a small nominal diameter to pass the USGA minimum diameter test.

What is needed is an improved surface pattern for golf balls that comprises both dimples and protrusions.

SUMMARY OF THE INVENTION

The present invention relates generally to surface patterns for round objects. In particular, the present invention relates to surface patterns for golf balls, the surface patterns including both depressions and protrusions. In a first embodiment, a golf ball comprising a core and a cover is provided. Other layers, such as an intermediate layer between the core and the cover, may also be present in the provided ball. Locations for turbulence generators are disposed on the outer surface of the cover. Dimples are disposed at some of the locations, and protrusions are disposed at other of the locations. The dimples and protrusions occupy different spatial positions on the surface.

The outer surface of the golf ball may be subdivided into a plurality of sections and these sections filled with substantially identical patterns of turbulence generator locations. For example, the surface may be subdivided into eight spherical triangles and each of the spherical triangles provided with a substantially identical location placement scheme. One such scheme might comprise arranging the locations in three concentric triangular rings, with dimples being positioned at the rest of the locations. Protrusions may be positioned at the vertices of each of the triangular rings. Each of the spherical triangles preferably contains from one to twenty protrusions, more preferably five to fifteen protrusions, and most preferably nine protrusions.

Alternatively, the outer surface may be subdivided into twenty spherical triangles and each of the spherical triangles provided with a substantially identical location placement scheme. One such scheme might comprise arranging the locations in three concentric triangular rings. Protrusions may be positioned at the vertices of each of the triangular rings, with dimples being positioned at the rest of the locations. Each of the spherical triangles preferably contains from one to twenty protrusions, more preferably five to fifteen protrusions, and most preferably nine protrusions.

The protrusions and dimples preferably cover greater than approximately 75% of the outer surface. More preferably, the protrusions and said dimples cover greater than approximately 80% of the surface. Most preferably, the protrusions and dimples cover greater than approximately 85% of the surface.

The protrusions preferably have a circular cross-section with a maximum diameter of approximately 0.020 inch to approximately 0.100 inch. More preferably, the maximum diameter is from approximately 0.040 inch to 0.080 inch. Most preferably, the maximum diameter is from approximately 0.050 inch to 0.070 inch. At least some of said protrusions can be negative dimples, and all of the protrusions may be negative dimples.

The ratio of protrusion coverage area to total dimple and protrusion coverage area is from approximately 0.01 to approximately 0.30. The ratio is more preferably from approximately 0.01 to approximately 0.20. The ratio is most preferably from approximately 0.01 to approximately 0.10.

In a second embodiment, a golf ball having an outer surface is provided. The outer surface comprises a plurality of dimples formed therein. There is an undimpled area between and among said dimples, in which a plurality of protrusions are located. The undimpled area may be contiguous, or there may be a plurality of undimpled areas over the surface of the ball. The dimples and protrusions preferably occupy different spatial positions on the surface.

The outer surface may be divided into a number of substantially identical areas, and each of the areas provided with a substantially identical arrangement of dimples. Each of the areas may further contain a substantially identical arrangement of protrusions.

The dimples preferably cover at least approximately 75% of the surface. More preferably, the dimples cover at least approximately 80% of the surface. Most preferably, the dimples cover at least approximately 85% of the surface.

In a third embodiment, a golf ball having an outer surface is provided. The outer surface comprises a plurality of protrusions formed therein. There is an unaltered area between and among said dimples, in which a plurality of protrusions are located.

The outer surface may be divided into a number of substantially identical areas, and each of the areas provided with a substantially identical arrangement of protrusions. Each of the areas may further contain a substantially identical arrangement of dimples. The unaltered area may be contiguous, or there may be a plurality of unaltered areas over the surface of the ball. The dimples and protrusions preferably occupy different spatial positions on the surface.

The protrusions preferably cover at least approximately 75% of the surface. More preferably, the protrusions cover at least approximately 80% of the surface. Most preferably, the protrusions cover at least approximately 85% of the surface.

In a fourth embodiment, a golf ball having an outer surface is provided. The outer surface comprises a plurality of turbulence generators including a plurality of dimples and a plurality of protrusions. The dimples and protrusions are positioned according to a scheme based on the principles of electromagnetic theory. The dimples and protrusions are positioned on the outer surface by assigning a charge value to each dimple and each protrusion, determining the potential of the charges, applying a solution method to minimize the potential, and altering locations of the dimples and protrusions according to the solution method. The outer surface of the golf ball may be divided into a plurality of sections and a substantially identical location pattern repeated in each of the sections.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
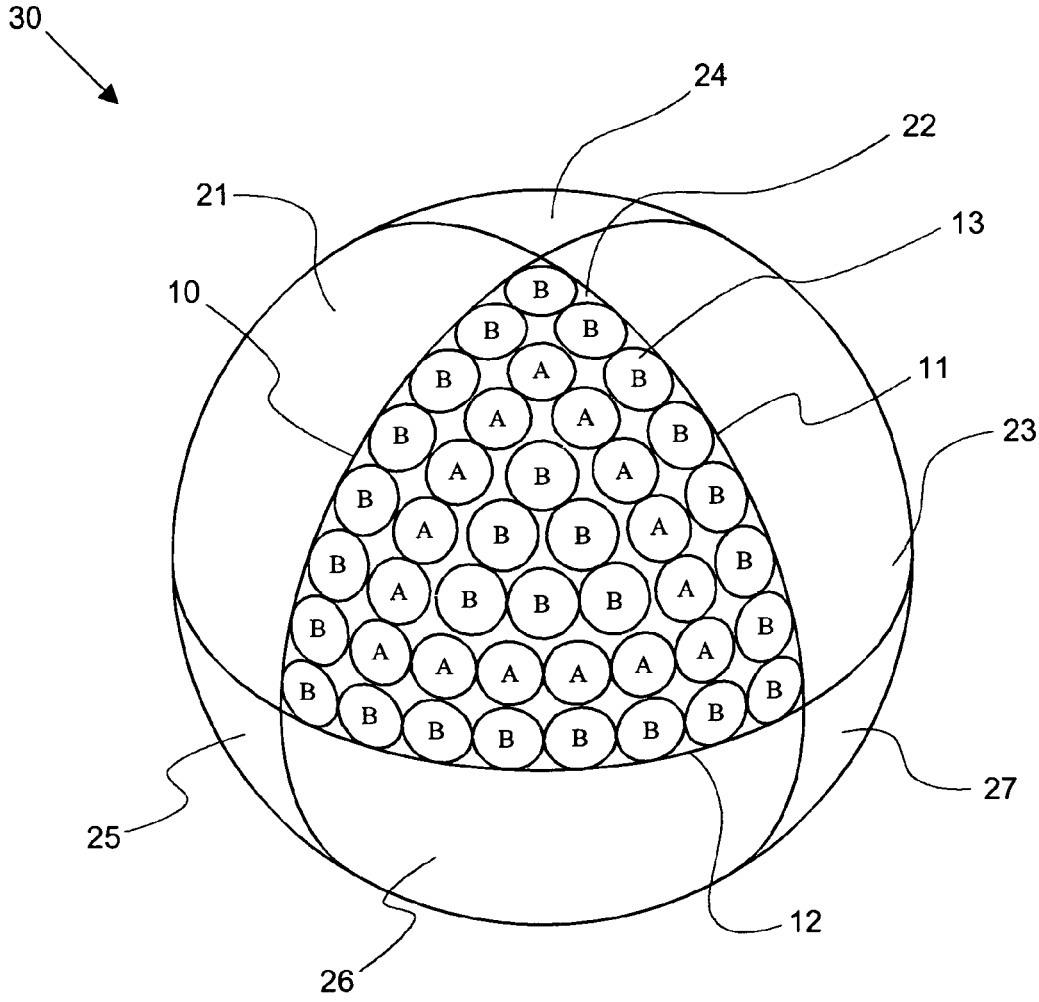
FIG. 1 illustrates a preferred embodiment of a golf ball of the present invention with an octahedron-based pattern of turbulence inducers.

The present invention relates to surface patterns for golf balls, the surface patterns including both dimples and protrusions. Conventional dimple placement geometries and schemes are used to identify positions for both dimples and protrusions on the golf ball surface to develop a high coverage pattern. The pattern layouts are designed to maximize surface coverage while minimizing aerodynamic drag and maintaining aerodynamic lift forces. The surface coverage of dimples and protrusions is preferably greater than approximately 75%. The surface coverage is more preferably greater than approximately 80%, and most preferably greater than approximately 85%. The dimple and protrusion distribution about the ball is symmetric and sufficient to satisfy the USGA's symmetry test, which states that "[t]he ball must not be designed, manufactured or intentionally modified to have properties which differ from those of a spherically symmetrical ball." Such a symmetric dimple/protrusion distribution also ensures there will be no adverse effect when putting the ball. The protrusions and dimples occupy different spatial positions on the golf ball surface. That is, there are no dimples within the protrusions or protrusions within the dimples.

The dimples and protrusions can be of similar or dissimilar geometric shapes. The dimples and protrusions will typically have a circular cross sectional profile. However, profiles of other shapes are also possible. Such other profiles include parabolic curve, ellipse, semi-spherical curve, saucer-shaped curve, sine curve, truncated cone, flattened trapezoid, constant depth/height, or the shape generated by revolving a catenary curve about its symmetrical axis. Other possible cross sectional profiles include triangles, squares, pentagons, hexagons, heptagons, octagons, etc.

The dimples preferably have a diameter or circumscribed diameter within the range of approximately 0.100 inch to approximately 0.180 inch. The dimple diameter range is more preferably from approximately 0.135 inch to 0.170 inch, and most preferably from approximately 0.140 inch to 0.165 inch. The dimple depth to diameter ratio may vary from one dimple to another.

The protrusions preferably have a diameter or circumscribed diameter within the range of approximately 0.020 inch to approximately 0.100 inch. The protrusion diameter range is more preferably from approximately 0.040 inch to approximately 0.080 inch, and most preferably from approximately 0.050 inch to approximately 0.070 inch. The protrusion height to diameter ratio may or may not be equal to the dimple depth to diameter ratio. Additionally, the protrusion height to diameter ratio may vary from one protrusion to another. Preferably, the protrusions have substantially the same height so putting is not adversely affected. Alternatively, the protrusions are "negative dimples." That is, the protrusions can be the same size as the dimples, except extending outward from the golf ball surface instead of inward.

The surface coverage ratio of protrusions to total coverage will vary with the chosen surface layout. Preferably, the protrusion to total coverage ratio is in the range of approximately 0.01 to approximately 0.30. More preferably the range is from approximately 0.01 to approximately 0.20, and most preferably the range is from approximately 0.01 to approximately 0.10. Use of the surface configurations according to the present invention allows the effective ball cross-section to be reduced, thus reducing drag and providing an alternate means to energize the flow field and influence lift.

The surface configurations according to the present invention may be formed in any manner that a cover is formed, and with any type of ball. Conventionally, golf balls are made by molding a cover around a core. The core may be wound, liquid, gel, or solid. A wound core typically comprises elastic thread wound about a solid or liquid center. Solid cores typically comprise a single solid piece center or a solid center covered by one or more mantle or intermediate layers of material. Wound cores may also include one or more mantle layers.

The cover may be injection molded, compression molded, or cast over the core. Injection molding typically requires a mold having at least one pair of mold cavities that mate to form a spherical recess. A mold may include more than one mold cavity pair. In one exemplary injection molding process, each mold cavity may also include retractable positioning pins to hold the core in the spherical center of the mold cavity pair. Once the core is positioned in the first mold cavity, the respective second mold cavity is mated to the first to close the mold. A cover material is then injected into the closed mold. The positioning pins are retracted while the cover material is flowable to allow the material to fill in any holes caused by the pins. When the material is at least partially cured, the covered core is removed from the mold (demolded).

Compression molds also typically include multiple pairs of mold cavities, each pair comprising first and second mold cavities that mate to form a spherical recess. In one exemplary compression molding process, a cover material is pre-formed into half-shells, which are placed, respectively, into each of a pair of compression mold cavities. The core is placed between the cover material half-shells and the mold is closed. The core and cover combination is then exposed to heat and pressure, which cause the cover half-shells to combine and form a full cover.

Casting processes also typically utilize pairs of mold cavities. In a casting process, a cover material is introduced into a first mold cavity of each pair. A core is then either placed directly into the cover material or is held in position (e.g., by an overhanging vacuum or suction apparatus) to contact the cover material in what will be the spherical center of the mold cavity pair. Once the cover material is at least partially cured (e.g., to a point where the core will not substantially move), the cover material is introduced into a second mold cavity of each pair, and the mold is closed. The closed mold is then subjected to heat and pressure to cure the cover material thereby forming a cover on the core.

The cover material may be of any known variety. The covers of today's golf balls are made from a variety of materials, such as balata, SURLYN®, and IOTEK®. Balata is a natural or synthetic trans-polyisoprene rubber. The softness of balata covered balls are favored by more highly skilled golfers because it allows the player to achieve spin rates sufficient to more precisely control ball direction and distance, particularly on shorter shots. Balata-covered balls, however, are easily damaged, and thus lack the durability required by the average golfer. Accordingly, alternative cover compositions have been developed in an attempt to provide balls with spin rates and a feel approaching those of balata covered balls, while also providing higher durability and overall distance.

Ionomer resins have, to a large extent, replaced balata as a cover material. Chemically, ionomer resins are a copolymer of an olefin and an $\alpha$, $\beta$-ethylenically-unsaturated carboxylic acid having 10 to 90 percent of the carboxylic acid groups neutralized by a metal ion, as disclosed in U.S. Pat. No. 3,264,272. Commercially available ionomer resins include, for example, copolymers of ethylene and methacrylic or acrylic acid, neutralized with metal salts. Examples of commercially available ionomer resins include, but are not limited to, SURLYN® from DuPont de Nemours and Company, and ESCOR® and IOTEK® from Exxon Corporation. These ionomer resins are distinguished by the type of metal ion, the amount of acid, and the degree of neutralization. However, while ionomer-covered golf balls possess virtually cut-proof covers, the spin and feel are inferior compared to balata covered balls.

Polyurethanes have also been recognized as useful materials for golf ball covers since about 1960. The resulting golf balls are durable and, unlike ionomer-covered golf balls, polyurethane golf ball covers can be formulated to possess the soft "feel" of balata covered golf balls. U.S. Pat. No. 4,123,061 teaches a golf ball made from a polyurethane prepolymer formed of polyether with diisocyanate that is cured with either a polyol or an amine-type curing agent. U.S. Pat. No. 5,334,673 discloses the use of two categories of polyurethane available on the market, i.e., thermoset and thermoplastic polyurethanes, for forming golf ball covers and, in particular, thermoset polyurethane-covered golf balls made from a composition of polyurethane prepolymer and a slow-reacting amine curing agent, and/or a difunctional glycol.

Polyureas have also been proposed as cover materials for golf balls. For instance, U.S. Pat. No. 5,484,870 discloses a polyurea composition comprising the reaction product of an organic diisocyanate and an organic amine, each having at least two functional groups. Once these two ingredients are combined, the polyurea is formed, and thus the ability to vary the physical properties of the composition is limited.

Exemplary embodiments of surface configurations for golf balls according to the present invention are presented below.

EXAMPLE 1

In a first exemplary embodiment, select dimples of a known dimple pattern are replaced with protrusions. One such known method of packing dimples on a golf ball divides the surface of the golf ball into eight spherical triangles corresponding to the faces of an octahedron, which is a solid bounded by eight triangular plane faces. Dimples are then positioned within each of the surface divisions according to a placement scheme. Alternatively, the surface divisions may be further divided and the resulting subdivisions packed with dimples. Octahedron-based dimple patterns generally cover approximately 60-75% of the golf ball surface with dimples. U.S. Pat. Nos. 5,415,410 and 5,957,786 disclose octahedron-based dimple patterns.

FIG. 1 shows the surface of a golf ball 30 divided into eight identical spherical triangular regions 21, 22, 23, 24, 25, 26, 27, and 28 (not visible) that correspond to the faces of a regular octahedron. The boundaries of these regions comprise three mutually orthogonal great circle paths 10, 11, and 12.

As seen in FIG. 1, region 22 has been filled with forty-two locations 13 arranged in three concentric triangular rings. The outer ring includes twenty-one locations, the intermediate ring includes fifteen locations, and the inner ring includes six locations. Preferably these locations are sized and positioned in such a way as to maximize coverage of the ball surface. This grouping of locations is the basic element that makes up the entire surface pattern.

As shown in FIG. 1, a preferred configuration of locations within each of regions 21-28 includes locations of two sizes, A and B. Table 1 below gives preferred values for the diameters of locations A and B.

TABLE 1

| Dimple | Diameter (in.) |
|---|---|
| A | 0.153 |
| B | 0.163 |

Figure 2A:
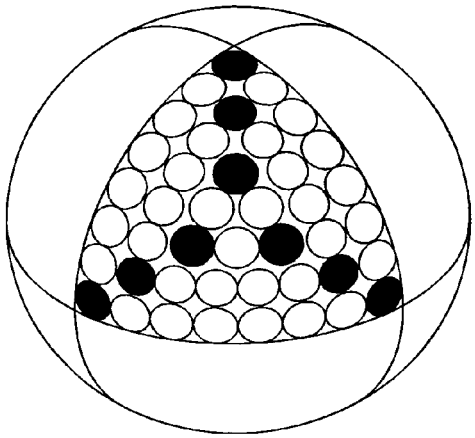
FIGS. 2A, 2B, and 2C illustrate the golf ball of FIG. 1 filled with preferred arrangements of locations for turbulence inducers.
Figure 2B:
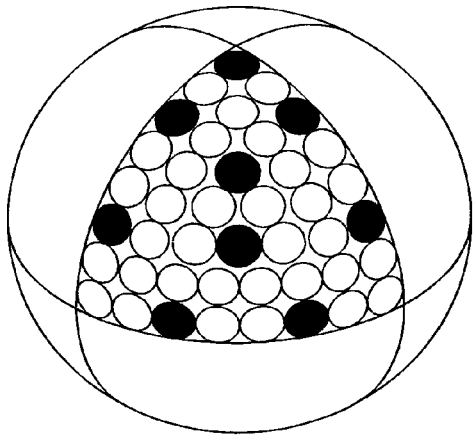
Figure 2C:
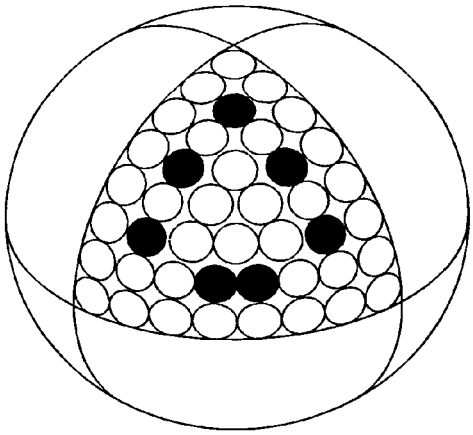

Some of locations 13 contain dimples and others of locations 13 contain protrusions. Each region 21-28 preferably contains between one and twenty protrusions. Each region more preferably contains five to fifteen protrusions, and most preferably nine protrusions. FIGS. 2A, 2B, and 2C show preferred configurations of dimple locations and protrusion locations within one of regions 21-28. All of the locations are shown as circles, and the circles representing protrusion locations have been colored. There are three hundred thirty-six turbulence inducers. In FIG. 2A, there are nine protrusions and thirty-three dimples. It follows that there are seventy-two protrusions and two hundred sixty-four dimples in the complete pattern. In FIG. 2B, there are also nine protrusions and thirty-three dimples in the region, and seventy-two protrusions and two hundred sixty-four dimples in the complete pattern. In FIG. 2C, there are seven protrusions and thirty-five dimples. It follows that there are fifty-six protrusions and two hundred eighty dimples in the complete pattern.

Another dimple packing method divides the surface of the golf ball into twenty spherical triangles corresponding to the faces of an icosahedron, which is a polyhedron having twenty triangular plane faces. Dimples are then positioned within each of the surface divisions according to a placement scheme. Alternatively, the surface divisions may be further divided and the resulting subdivisions packed with dimples. Because most icosahedron-based dimple patterns incorporate a high degree of hexagonal packing, they typically achieve more than 75% dimple coverage. U.S. Pat. Nos. 4,560,168 and 5,957,786 disclose icosahedron-based dimple patterns.

Figure 3:
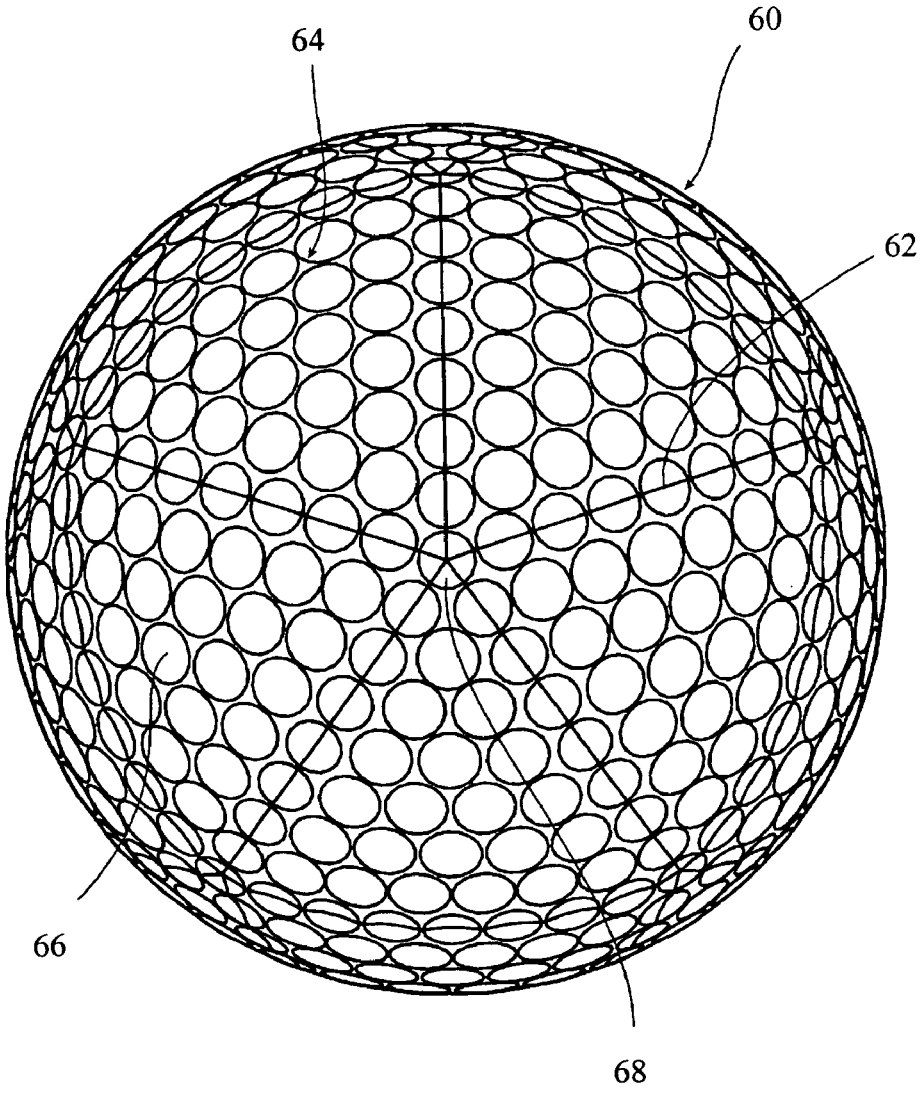
FIG. 3 illustrates another preferred embodiment of a golf ball of the present invention with an icosahedron-based pattern of turbulence generators.

FIG. 3 illustrates a golf ball 60 with an icosahedron surface pattern having six hundred forty-two locations 66. Solid lines 62 on golf ball 60 form twenty icosahedral spherical triangles 64, which correspond to faces of a regular icosahedron. Golf ball 60 has a pattern of locations 66 that is substantially repeated in each icosahedral triangle 64. The icosahedron pattern has five triangles 64 formed at each of the polar regions of the ball 60. Each of these groupings of five triangles 64 shares a vertex dimple 68. There are also ten triangles 64 that extend around the equatorial region of the ball 60. Because dimples positioned on the outermost rows are shared by adjacent triangles 64, each of the vertices of triangles 64 is a vertex dimple 68.

In the pattern shown in FIG. 3, each triangle 64 includes locations 66 of two sizes formed in three concentric triangles. Locations B, disposed along the edges of the outer icosahedral triangle (triangle 64), have a smaller diameter than locations A, which are disposed centrally within the icosahedral triangle 64, along the edges of the middle and inner concentric triangles. Preferred diameters of the locations 66 are as given in Table 2 below.

TABLE 2

| Dimple | Diameter (in.) |
|---|---|
| A | 0.120 |
| B | 0.110 |

Adjacent rows of locations 66 are relatively staggered. This creates a hexagonal packing in which almost all locations 66 are surrounded by six other locations 66. Preferably, at least 75% of the locations 66 have six adjacent locations 66. More preferably, only the vertex locations 68 do not have hexagonal packing.

Preferably, less than 30% of the spacings between adjacent locations 66 are greater than 0.01 inches. For purposes of this patent, any two locations 66 are considered adjacent where two lines segments drawn from a point tangent to each location to the center of the other location (a total of four line segments) do not intersect any other location 66. Also, locations with edges within about 0.03 inches of one another are also considered adjacent. See U.S. Pat. No. 6,299,552 for additional discussion regarding adjacent locations. More preferably, less than 15% of the spacings between adjacent locations 66 are greater than 0.01 inches.

Golf ball 60 contains no great circle path other than at the parting line that does not intersect any locations 66. This increases the percentage of the outer surface that is covered by locations 66. Providing one great circle along the equator that does not intersect any locations 66 facilitates manufacturing, particularly the step of buffing the parting line of the golf balls after demolding. Furthermore, many players prefer to have an equator without locations that they can use to line up the ball for putting. Thus, surface patterns often have modified triangles 64 around the mid-section to create an equator that does not intersect any locations 66. Alternatively, the pattern may be designed such that there is no great circle path that does not intersect any locations 66.

Figure 4:
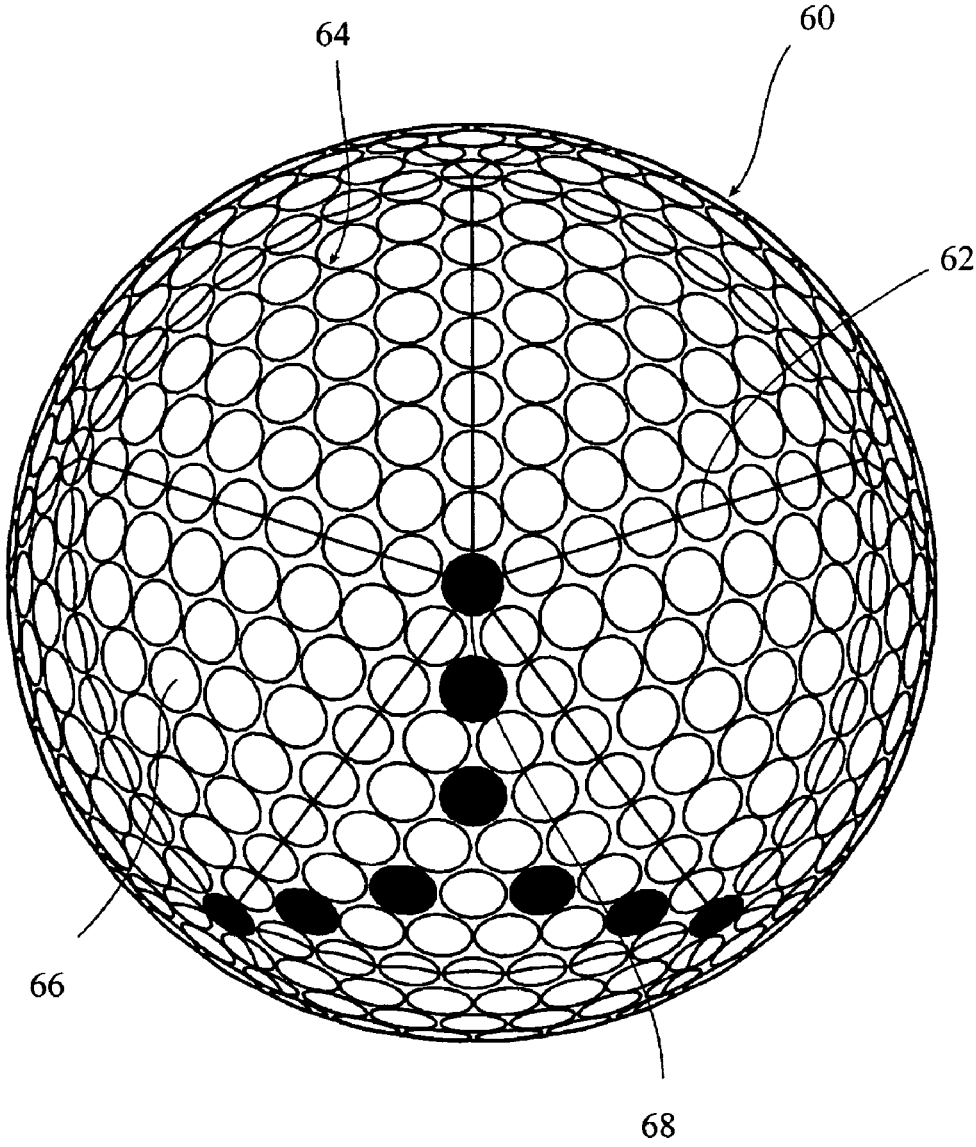
FIG. 4 illustrates the golf ball of FIG. 3 filled with a preferred arrangement of locations for turbulence inducers.

Some of locations 66 contain dimples and others of locations 66 contain protrusions. Each spherical triangle 64 preferably contains between one and twenty protrusions. Each spherical triangle 64 more preferably contains five to fifteen protrusions, and most preferably nine protrusions. FIG. 4 shows a preferred configuration of dimple locations and protrusion locations within one triangle 64. Numerous other configurations can also be used. The locations 66 representing protrusions have been colored. The locations 66 at the vertices of each of the concentric triangles are protrusion locations. The remaining locations 66 are dimple locations. Thus, in each triangle 64 there are nine protrusion locations and thirty-six dimple locations. It follows that in the completed surface pattern there are one hundred thirty-two protrusions and five hundred ten dimples, totaling six hundred forty-two turbulence inducers.

EXAMPLE 2

Figure 5:
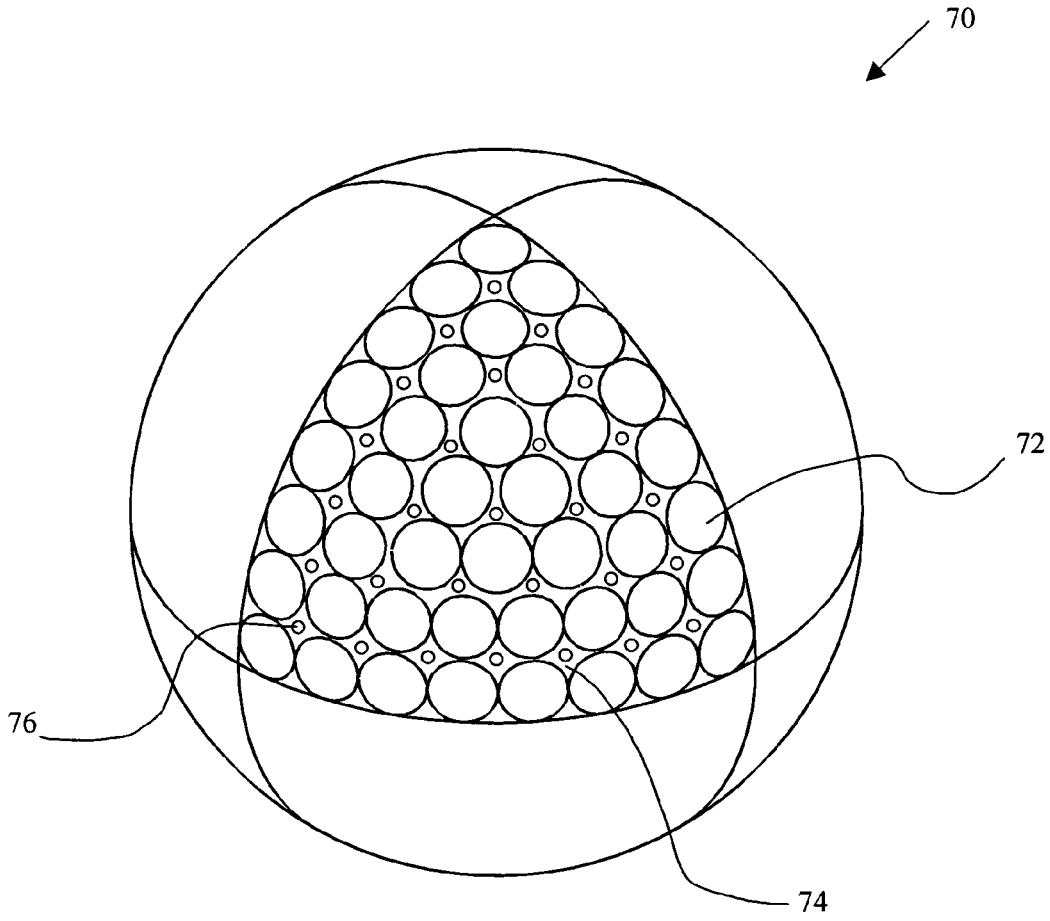
FIG. 5 illustrates another preferred embodiment of a golf ball of the present invention.

FIG. 5 illustrates a second embodiment of a golf ball 70 of the present invention. Golf ball 70 has a plurality of dimples 72 arranged thereon according to a known placement scheme. While an octahedron-based dimple pattern is shown as the illustrative embodiment, any dimple pattern may be used.

When dimples are formed in a golf ball cover, there are necessarily areas of the cover that are not covered by a dimple. These areas are called land area or lands. These unaltered or undimpled areas are spread over the surface of the golf ball. The percentage of the ball surface that the lands comprise is dependent upon the ball's dimple pattern. The surface coverage of dimples is preferably greater than approximately 75%, with the remainder of the surface comprising land areas. The surface coverage is more preferably greater than approximately 80%, and most preferably greater than approximately 85%. The land area works with the turbulence generators to create a turbulent flow of air behind the golf ball. Depending on the specific dimple pattern, the land areas may be connected such that there is a single land area jaggedly connected over the surface of the ball, or there may be a plurality of independent land areas spread over the surface of the ball.

In addition to dimples 72, golf ball 70 contains a plurality of protrusions 76. Protrusions 76 are positioned on land areas 74 of golf ball 70. That is, protrusions 76 are placed between and among dimples 72. Dimples 72 are positioned on golf ball 70 pursuant to a known dimple placement pattern, and then the protrusion locations are selected. The locations of protrusions 76 can be selected by manual placement or with a distribution method. Protrusions 76 and dimples 72 are distributed about the surface of the golf ball such that the golf ball will exhibit substantially symmetric flight characteristics regardless of where the golf club (or other device) strikes the ball. Placing protrusions on the land spaces increases the percentage of the golf ball surface that is being used to generate a turbulent flow around the ball.

Regarding the spherical triangle region of FIG. 5, protrusions 76 are positioned between the concentric triangles of the octahedron dimple pattern. This placement results in a symmetric distribution of protrusions 76 among dimples 72 and over the entire surface of golf ball 70. Twenty-eight protrusions are shown in the example of FIG. 5. More or fewer protrusions 70 can be used. The number of protrusions used will typically be chosen based on the pattern used for positioning dimples 72.

EXAMPLE 3

In a third exemplary embodiment of the present invention, a protrusion pattern is selected and dimples are positioned around the protrusions. The dimples are preferably positioned on unaltered land areas among and between the protrusions. This embodiment is also illustrated in FIG. 5, but with reference 72 identifying protrusions and reference 76 identifying dimples.

In this embodiment, protrusions are arranged on the surface of a golf ball according to a known pattern. Patterns traditionally used to place dimples on a golf ball, such as the octahedron and icosahedron patterns discussed above, may be used. The dimple locations can be selected by manual placement or with a distribution method. The protrusions and the dimples are distributed about the surface of the golf ball such that the golf ball will exhibit substantially symmetric flight characteristics regardless of where the golf club (or other device) strikes the ball. Like the embodiment of example 2, placement of turbulence generators on the land areas of the golf ball of example 3 increases the percentage of the golf ball surface that is being used to generate a turbulent flow around the ball. The number and size of the dimples will depend on the pattern used for positioning the protrusions.

EXAMPLE 4

In a fourth exemplary embodiment, dimples and protrusions are positioned according to a scheme based on the principles of electromagnetic theory. Such a theory is disclosed in U.S. patent application Ser. No. 10/237,680, now pending, entitled "Dimpled Golf Ball and Dimple Distribution Method," which is incorporated herein by reference. Generally, locations for turbulence generators are initially determined on the golf ball surface or on a portion of the surface. The locations may be placed randomly within the space or may be selected and arranged by any means known to those skilled in the art. Once the locations are arranged on the ball surface, each location is then assigned a charge. Different charge values may be provided for locations differing in size or shape in order to account for these differences. Alternatively, the locations may be assigned similar charge values with differences in location sizes or shapes accounted for afterwards in any suitable manner.

The assigned charge values and positions of the locations are then utilized to determine the potential energy PE, referred to from hereon as just the potential. Once the potential PE is determined, a solution method is then used to minimize PE. For example, the solution method used may be gradient-based. The locations are subsequently altered and the analysis is repeated until the potential PE reaches zero or an acceptable minimum within a specified tolerance. Examples of acceptable minimums may include when further iteration causes PE to change by less than 1 percent or ½ percent.

Any number of convergence criteria may be used to halt the optimization process. One skilled in the art will appreciate that error analysis and rate of convergence are essential elements in the implementation of any iterative numerical algorithm. Therefore, it is sufficient to note that an acceptable solution may be found when an appropriate convergence criteria or criterion is satisfied. If the potential PE is not within an accepted range or tolerance, the locations are altered according to the gradient and the process is repeated. The potential PE is recalculated and compared again to the accepted range or tolerance. This process may be repeated until the locations fall within acceptable tolerances.

More than one solution method may be utilized to further minimize the potential PE. For instance, numerical optimization can include a multi-method approach as well where a gradient method is used to identify a good initial guess at the minimum and then higher order methods, such as Newton or Quasi-Newton methods, may be used to accelerate the rate of convergence. Once the potential PE is zero or within an accepted range or tolerance, the locations no longer need to be repositioned.

As mentioned above, the arrangement of the locations on the surface of the golf ball according to the concepts described herein may be performed on the entire surface of the golf ball or a portion thereof. In one embodiment, the surface is approximately half of the surface of the ball, preferably with allowance for locations to not be placed near the parting line of the mold assembly. Thus, a portion of the surface of the golf ball, such as a mold parting line, may be designated as not being suitable for placement of locations.

Likewise, portions of the golf ball surface may be configured with locations that are not adjusted according to the methods described herein. For instance, the location and size of locations on a golf ball corresponding to a vent pin or retractable pin for an injection mold may be selected in order to avoid significant retooling of molding equipment. Maintaining the selected size and position of these locations may be accomplished by defining the portions of the ball where locations will be arranged according to the methods described herein so that the defined portion of the ball surface excludes the locations that are to remain in their selected position.

When the locations are rearranged on only a portion of the golf ball, the pattern generated may be repeated on the remaining surface of the ball or on another portion of the golf ball. For instance, if the surface on which the locations are arranged corresponds approximately to a hemisphere of the ball, the pattern may be duplicated on the remainder of the ball surface that corresponds to a similar approximation of a hemisphere. If the locations are arranged on smaller regions, the pattern generated may be duplicated or repeated on other portions of the ball. Thus, it is not necessary that the totality of the defined spaces in which locations are placed cover the entire golf ball. Any undefined spaces may have additional locations added either before or after the process described herein for arranging locations in the defined space.

Once the potential is zero or within an accepted range or tolerance, any remaining portions or undefined spaces on the ball may be filled in with additional locations. As mentioned above, locations may be placed in these remaining portions or undefined spaces in any manner, including by use of the present invention. Once all of the locations have been arranged on the ball, the pattern then may be compared to any combination of acceptance criteria to determine whether the location arrangement is complete.

Examples of suitable acceptance criteria may include, but are not limited to, surface coverage, symmetry, overlap, spacing, and distribution of the locations. For example, a pattern having less than 65 percent coverage may be rejected as not having sufficient surface coverage, whereas a pattern having about 74 percent or more surface coverage may be acceptable.

Location distribution is another factor that may be included as part of the acceptance criteria of a location pattern. For instance, the pattern may be rejected if locations of a particular size are concentrated in a localized area instead of being relatively uniformly distributed on the ball surface.

Location overlap and spacing are additional factors that may be considered when evaluating a pattern. It is preferred that the outer boundary of one location does not intersect with an outer boundary of another location on the ball. If this occurs, either one or both of the overlapping locations may be repositioned or altered in size in order to remedy the overlap. Once this location size or position has been altered, it may be desirable to reanalyze the potential PE and apply a solution method until it reaches zero or an accepted range or tolerance. The same steps may also be taken when location spacing is at issue instead of location overlap. Thus, locations deemed too close to each other or perhaps too close to a particular region of the ball, such as the parting line of the mold, may be resized or repositioned in the manner described above.

Figure 6:
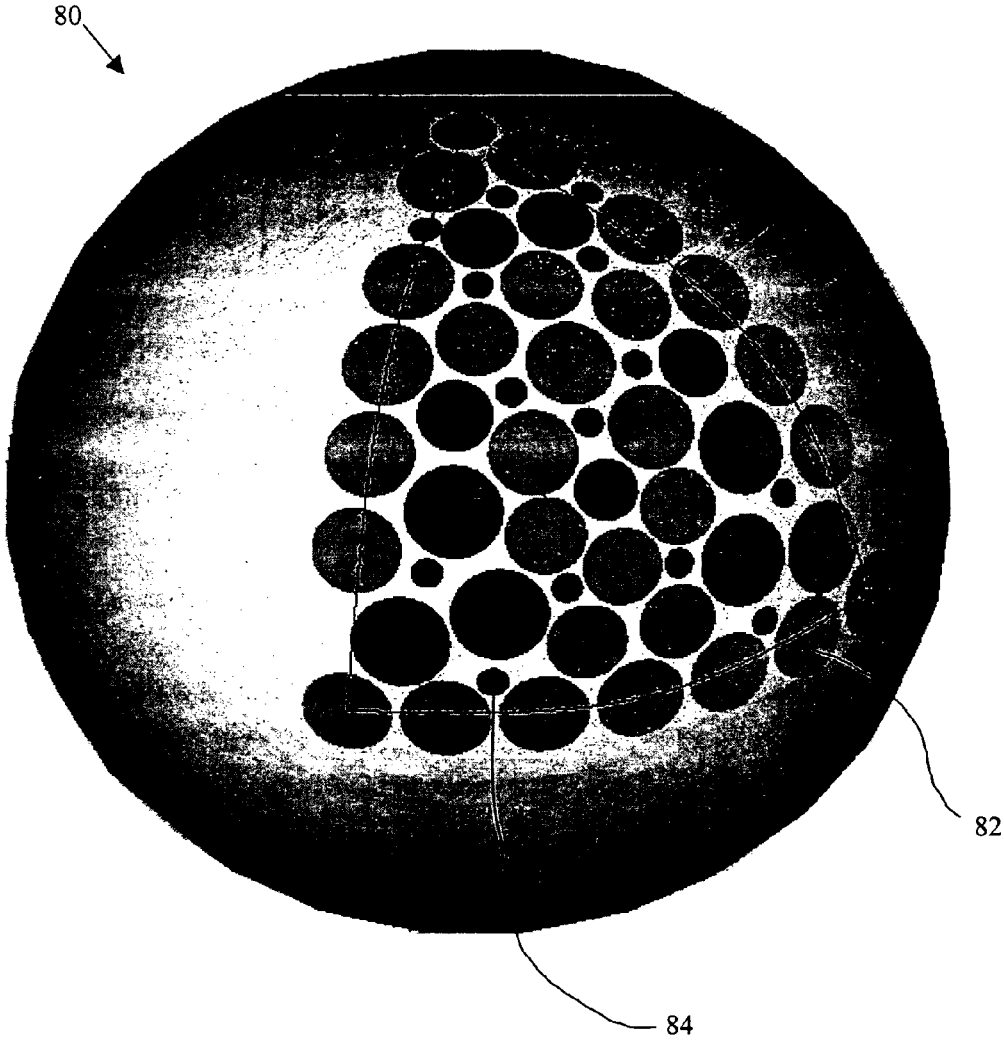
FIG. 6 illustrates another preferred embodiment of a golf ball of the present invention.

FIG. 6 shows a golf ball 80 with a pattern of locations positioned according to a scheme based on the principles of electromagnetic theory. The pattern includes dimples 82 and protrusions 84. Dimples of five sizes are used in the illustrated embodiment. Dimples 82 and protrusions 84 are positioned according to the electromagnetic placement scheme described above. In the illustrated embodiment, the dimples and protrusions were distributed in a section of the golf ball surface. This section is then repeated around the ball to generate the complete pattern.

Aerodynamics

The present invention is directed to golf balls having improved aerodynamic efficiency, resulting in uniformly increased flight distance for golfers of all swing speeds. In particular, the present invention is directed to the selection of dimple and protrusion arrangements to obtain a unique set of aerodynamic criteria, which results in consistently improved aerodynamic efficiency. The desired aerodynamic criteria can be defined by the magnitude and direction of the aerodynamic force, for the range of Spin Ratios and Reynolds Numbers that encompass the flight regime for typical golf ball trajectories. See U.S. patent application Ser. No. 10/096,852, filed on Mar. 14, 2002 and entitled "Golf Ball with Improved Flight Performance," which is incorporated by reference herein in its entirety.

The forces acting on a golf ball in flight are enumerated in Equation 1:

$$F=F_L+F_D+F_G \quad \text{(Eq. 1)}$$

where:

F=total force acting on the ball, $F_L$=lift force, $F_D$=drag force, and $F_G$=gravity force.

The lift force ($F_L$) acts in a direction dictated by the cross product of the spin vector and the velocity vector. The drag force ($F_D$) acts in a direction that is directly opposite the velocity vector. The lift and drag forces of Equation 1 are calculated in Equations 2 and 3, respectively:

$$F_L=0.5C_L\rho AV^2 \quad \text{(Eq. 2)}$$

$$F_D=0.5C_D\rho AV^2 \quad \text{(Eq. 3)}$$

where:

ρ=density of air (slugs/ft$^3$),

A=projected area of the ball (ft$^2$) ((π/4)D$^2$),

D=ball diameter (ft),

V=ball velocity (ft/s), $C_L$=dimensionless lift coefficient, and $C_D$=dimensionless drag coefficient.

Lift and drag coefficients are used to quantify the force imparted to a ball in flight and are dependent on air density, air viscosity, ball speed, and spin rate. The influence of all these parameters may be captured by two dimensionless parameters: Spin Ratio (SR) and Reynolds Number ($N_{Re}$). Spin Ratio is the rotational surface speed of the ball divided by ball velocity. Reynolds Number quantifies the ratio of inertial to viscous forces acting on the golf ball moving through air. SR and $N_{Re}$ are calculated in Equations 4 and 5 below:

$$SR=\omega(D/2)/V \quad \text{(Eq. 4)}$$

$$N_{Re}=DV\rho/\mu \quad \text{(Eq. 5)}$$

where:

ω=ball rotation rate (radians/s) (2π(RPS)),

RPS=ball rotation rate (revolution/s),

V=ball velocity (ft/s),

D=ball diameter (ft),

ρ=air density (slugs/ft$^3$), and

μ=absolute viscosity of air (lb/ft-s).

There are a number of suitable methods for determining the lift and drag coefficients for a given range of SR and $N_{Re}$, including the use of indoor test ranges with ballistic screen technology. U.S. Pat. No. 5,682,230, the entire disclosure of which is incorporated by reference herein, teaches the use of a series of ballistic screens to acquire lift and drag coefficients. U.S. Pat. Nos. 6,186,002 and 6,285,445, also incorporated in their entireties by reference herein, disclose methods for determining lift and drag coefficients for a given range of velocities and spin rates using an indoor test range, wherein the values for $C_L$ and $C_D$ are related to SR and $N_{Re}$ for each shot. One skilled in the art of golf ball aerodynamics testing could readily determine the lift and drag coefficients through the use of an indoor test range.

The present invention is directed to a golf ball having improved flight distance as defined by two parameters that account for both lift and drag simultaneously: 1) the magnitude of aerodynamic force ($C_{mag}$); and 2) the direction of the aerodynamic force (Angle). Flight performance improvements are attained when the pattern and profile of turbulence generators are selected to satisfy specific magnitude and direction criteria. The magnitude and angle of the aerodynamic force are linearly related to the lift and drag coefficients and, therefore, the magnitude and angle of the aerodynamic coefficients are used to establish the preferred criteria. The magnitude and the angle of the aerodynamic coefficients are defined in Equations 6 and 7 below:

$$C_{mag}=\sqrt{(C_L^2+C_D^2)} \quad \text{(Eq. 6)}$$

$$\text{Angle}=\tan^{-1}(C_L/C_D) \quad \text{(Eq. 7)}$$

Table 3 illustrates the aerodynamic criteria for a golf ball of the present invention that results in increased flight distances. The criteria are specified as low, median, and high $C_{mag}$ and Angle for eight specific combinations of SR and $N_{Re}$. Golf balls with $C_{mag}$ and Angle values between the low and the high number are preferred. More preferably, the golf balls of the invention have $C_{mag}$ and Angle values between the low and the median numbers delineated in Table 3. The $C_{mag}$ values delineated in Table 3 are intended for golf balls that conform to USGA size and weight regulations. The size and weight of the golf balls used with the aerodynamic criteria of Table 3 are 1.68 inches and 1.62 ounces, respectively.

TABLE 3

Aerodynamic Characteristics
Ball Diameter = 1.68 inches, Ball Weight = 1.62 ounces

| | | Magnitude[1] | | | Angle[2] (°) | | |
|---|---|---|---|---|---|---|---|
| $N_{Re}$ | SR | Low | Med. | High | Low | Med. | High |
| 230000 | 0.085 | 0.24 | 0.265 | 0.27 | 31 | 33 | 35 |
| 207000 | 0.095 | 0.25 | 0.271 | 0.28 | 34 | 36 | 38 |
| 184000 | 0.106 | 0.26 | 0.280 | 0.29 | 35 | 38 | 39 |
| 161000 | 0.122 | 0.27 | 0.291 | 0.30 | 37 | 40 | 42 |
| 138000 | 0.142 | 0.29 | 0.311 | 0.32 | 38 | 41 | 43 |
| 115000 | 0.170 | 0.32 | 0.344 | 0.35 | 40 | 42 | 44 |
| 92000 | 0.213 | 0.36 | 0.390 | 0.40 | 41 | 43 | 45 |
| 69000 | 0.284 | 0.40 | 0.440 | 0.45 | 40 | 42 | 44 |

[1]As defined by Eq. 6
[2]As defined by Eq. 7

To ensure consistent flight performance regardless of ball orientation, the percent deviation of $C_{mag}$ for each of the SR and $N_{Re}$ combinations listed in Table 3 plays an important role. The percent deviation of $C_{mag}$ may be calculated in accordance with Equation 8, wherein the ratio of the absolute value of the difference between the $C_{mag}$ for two orientations to the average of the $C_{mag}$ for the two orientations is multiplied by 100.

$$\text{Percent devitaion } C_{mag}=|(C_{mag1}-C_{mag2})|/((C_{mag1}+C_{mag2})/2)*100 \quad \text{(Eq. 8)}$$

where:

$C_{mag1}=C_{mag}$ for orientation 1, and $C_{mag2}=C_{mag}$ for orientation 2.

In one embodiment, the percent deviation is about 6 percent or less. In another embodiment, the deviation of $C_{mag}$ is about 3 percent or less. To achieve the consistent flight performance, the percent deviation criteria of Equation 8 is preferably satisfied for each of the eight $C_{mag}$ values associated with the eight SR and $N_{Re}$ values contained in Table 3.

Aerodynamic asymmetry typically arises from parting lines inherent in the dimple arrangement or from parting lines associated with the manufacturing process. The percent $C_{mag}$ deviation should be obtained using $C_{mag}$ values measured with the axis of rotation normal to the parting line, commonly referred to as a poles horizontal, PH, orientation and $C_{mag}$ values measured in an orientation orthogonal to PH, commonly referred to as a pole over pole, PP orientation. The maximum aerodynamic asymmetry is generally measured between the PP and PH orientation.

One of ordinary skill in the art would be aware, however, that the percent deviation of $C_{mag}$ as outlined above applies to PH and PP, as well as any other two orientations. For example, if a particular turbulence generator pattern is used having a great circle of shallow dimples, different orientations should be measured. The axis of rotation to be used for measurement of symmetry in the above example scenario would be normal to the plane described by the great circle and coincident to the plane of the great circle.

The $C_{mag}$ and Angle criteria delineated in Table 3 for golf balls with a nominal diameter of 1.68 and a nominal weight of 1.62 ounces may be advantageously scaled to obtain the similar optimized criteria for golf balls of any size and weight. The aerodynamic criteria of Table 3 may be adjusted to obtain the $C_{mag}$ and angle for golf balls of any size and weight in accordance with Equations 9 and 10.

$$C_{mag(ball)}=C_{mag(Table\ 3)}\sqrt{(\sin(\text{Angle}_{(Table1)})*(W_{ball}/1.62)*(1.68/D_{ball})^2)^2+(\cos(\text{Angle}_{(Table1)})^2)} \quad \text{(Eq. 9)}$$

$$\text{Angle}_{(ball)}=\tan^{-1}(\tan(\text{Angle}_{(Table\ 3)})*(W_{ball}/1.62)*(1.68/D_{ball})^2) \quad \text{(Eq. 10)}$$

For example, Table 4 illustrates aerodynamic criteria for balls with a diameter of 1.60 inches and a weight of 1.7 ounces as calculated using Table 3, ball diameter, ball weight, and Equations 9 and 10.

TABLE 4

Aerodynamic Characteristics
Ball Diameter = 1.60 inches, Ball Weight = 1.70 ounces

| | | Magnitude[1] | | | Angle[2] (°) | | |
|---|---|---|---|---|---|---|---|
| $N_{Re}$ | SR | Low | Med. | High | Low | Med. | High |
| 230000 | 0.085 | 0.24 | 0.265 | 0.27 | 31 | 33 | 35 |
| 207000 | 0.095 | 0.262 | 0.287 | 0.297 | 38 | 40 | 42 |
| 184000 | 0.106 | 0.271 | 0.297 | 0.308 | 39 | 42 | 44 |
| 161000 | 0.122 | 0.83 | 0.311 | 0.322 | 42 | 44 | 46 |
| 138000 | 0.142 | 0.304 | 0.333 | 0.346 | 43 | 45 | 47 |
| 115000 | 0.170 | 0.337 | 0.370 | 0.383 | 44 | 46 | 49 |

TABLE 4-continued

| Aerodynamic Characteristics Ball Diameter = 1.60 inches, Ball Weight = 1.70 ounces | | | | | | | |
|---|---|---|---|---|---|---|---|
| | | Magnitude[1] | | | Angle[2] (°) | | |
| $N_{Re}$ | SR | Low | Med. | High | Low | Med. | High |
| 92000 | 0.213 | 0.382 | 0.420 | 0.435 | 45 | 47 | 50 |
| 69000 | 0.284 | 0.430 | 0.473 | 0.489 | 44 | 47 | 49 |

[1]As defined by Eq. 9
[2]As defined by Eq. 10

One way of adjusting the magnitude of aerodynamic coefficients and angle of aerodynamic force for a ball to satisfy the aerodynamic criteria of Table 3 is through different turbulence generator patterns and profiles. Golf balls may also be designed to fit the aerodynamic criteria of Table 3 by creating dimple patterns wherein all dimples have fixed radii and depth, but vary as to shape. For example, dimple shape variations may be defined as edge radius and edge angle or by catenary shape factor and edge radius.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. The pertinent parts of all patents specifically referenced above by number are incorporated herein by reference.

What is claimed is:

1. A golf ball, comprising:

a core;

a cover disposed over the core, the cover having a surface containing a plurality of locations;

dimples disposed on said surface at various of said locations; and protrusions disposed on said surface at various of said locations and occupying approximately 25% or less of said surface;

wherein said dimples and said protrusions occupy different spatial positions on said surface.

2. The golf ball of claim 1, further comprising an intermediate layer between said core and said cover.

3. The golf ball of claim 1, wherein said locations are defined by subdividing said surface into eight spherical triangles, each of said spherical triangles continuing a substantially identical location placement scheme.

4. The golf ball of claim 3, wherein each of said spherical triangles contains three concentric triangular rings of locations.

5. The golf ball of claim 4, wherein protrusions are positioned at the vertices of each of said triangular rings.

6. The golf ball of claim 3, wherein each of said spherical triangles contains from one to twenty protrusions.

7. The golf ball of claim 3, wherein each of said spherical triangles contains from five to fifteen protrusions.

8. The golf ball of claim 3, wherein each of said spherical mangles contains nine protrusions.

9. The golf ball of claim 1, wherein said locations are defined by subdividing said surface into twenty spherical triangles, each of said spherical triangles containing a substantially identical location placement scheme.

10. The golf ball of claim 9, wherein each of said spherical triangles contains three concentric triangular rings of locations.

11. The golf ball of claim 10, wherein protrusions are positioned at the vertices of each of said triangular rings

12. The golf ball of claim 9, wherein each of said spherical triangles contains from one to twenty protrusions.

13. The golf ball of claim 9, wherein each of said spherical triangles contains from five to fifteen protrusions.

14. The golf ball of claim 9, wherein each of said spherical triangles contains nine protrusions.

15. The golf ball of claim 1, wherein said protrusions and said dimples cover greater than approximately 75% of said surface.

16. The golf ball of claim 1, wherein said protrusions and said dimples cover greater than approximately 80% of said surface

17. The golf ball of claim 1, wherein said protrusions and said dimples cover greater than approximately 85% of said surface.

18. The golf ball of claim 1, wherein said protrusions include protrusions having a circular cross-section with a maximum diameter of approximately 0.020 inch to approximately 0100 inch.

19. The golf ball of claim 18, wherein said maximum diameter is from approximately 0.040 inch to 0.080 inch.

20. The golf ball of claim 18, wherein said maximum diameter is from approximately 0.050 inch to 0.070 inch.

21. The golf ball of claim 1, wherein a ratio of protrusion coverage area to total dimple and protrusion coverage area is from approximately 0.01 to approximately 0.30.

22. The golf ball of claim 21, wherein said ratio is from approximately 0.01 to approximately 0.20.

23. The golf ball of claim 21, wherein said ratio is from approximately 0.01 to approximately 0.10.

24. The golf ball of claim 1, wherein at least some of said protrusions are negative dimples.

25. The golf ball of claim 24, wherein all of said protrusions are negative dimples.

26. The golf ball of claim 1, wherein said dimples cover at least approximately 75% of said surface.

27. A golf ball having an outer surface, the outer surface comprising:

a plurality of dimples formed therein;

an undimpled area between and among said dimples; and a plurality of protrusions located in said undimpled area and occupying Approximately 25% or less of the outer surface.

28. The golf ball of claim 27, wherein the outer surface is divided into a number of substantially identical areas, each of said areas containing a substantially dentical arrangement of dimples.

29. The golf ball of claim 28, wherein each of said areas further contains a substantially identical arrangement of protrusions.

30. The golf ball of claim 27, wherein the outer surface comprises a plurality of undimpled areas.

31. The golf ball of claim 30, wherein a plurality of said undimpled areas contains protrusions.

32. The golf ball of claim 27, wherein said dimples and sail protrusions occupy different spatial positions on said surface.

33. The golf ball of claim 27, wherein said dimples cover at least approximately 75% of the surface.

34. A golf ball having an outer surface, the outer surface comprising:

a plurality of dimples formed therein;

an undimpled area between and among said dimples; and a plurality of protrusions located in said undimpled area; wherein said dimples cover at least approximately 75% of the surface.

35. The golf ball of claim 34, wherein said dimples cover at least approximately 80% of the surface.

36. The golf ball of claim 34, wherein said dimples cover at least approximately 85% of the surface.

* * * * *